US005807133A

United States Patent [19]

Arnett

[11] Patent Number: 5,807,133

[45] Date of Patent: Sep. 15, 1998

[54] INSULATION DISPLACEMENT CONNECTOR

[75] Inventor: Jaime Ray Arnett, Fishers, Ind.

[73] Assignee: Lucent Technologies Inc., Murray Hill, N.J.

[21] Appl. No.: 834,199

[22] Filed: Apr. 15, 1997

[51] Int. Cl.[6] ..... H01R 4/24

[52] U.S. Cl. ..... 439/418; 439/441; 29/866

[58] Field of Search ..... 439/838–441, 439/418, 676; 29/857, 865–867

[56] References Cited

U.S. PATENT DOCUMENTS

| | | | |
|---|---|---|---|
| 3,027,536 | 3/1962 | Pasternak . | |
| 3,474,389 | 10/1969 | Nagano | 439/440 |
| 3,761,869 | 9/1973 | Hardesty et al. . | |
| 3,798,587 | 3/1974 | Ellis, Jr. et al. . | |
| 3,860,316 | 1/1975 | Hardesty . | |
| 3,879,099 | 4/1975 | Shaffer . | |
| 4,002,392 | 1/1977 | Hardesty . | |
| 4,105,276 | 8/1978 | Miller | 439/441 |
| 4,133,595 | 1/1979 | Pritulsky | 439/441 |
| 4,451,104 | 5/1984 | Hodgson et al. . | |
| 4,624,521 | 11/1986 | Vachhani . | |
| 4,648,678 | 3/1987 | Archer . | |
| 4,826,449 | 5/1989 | Debortoli et al. . | |
| 4,929,190 | 5/1990 | Gonon et al. . | |
| 4,975,078 | 12/1990 | Stroede et al. . | |
| 5,304,074 | 4/1994 | Andre et al. . | |

*Primary Examiner*—Gary F. Paumen

[57] ABSTRACT

An electrical contact with an insulated wire conductor is established by defining a wire passage in a connector housing to receive an insulated wire conductor, and capturing a contact member having an electrically conductive hook portion in the housing. An end of the hook portion projects into the wire passage. When an insulated wire conductor is fed into the passage, insulation on the conductor slides along the hook portion of the contact member. Upon withdrawing or displacing the conductor a certain distance relative to the hook portion, an end of the hook portion engages and pierces the insulation on the conductor to make electrical contact with the conductor.

12 Claims, 5 Drawing Sheets

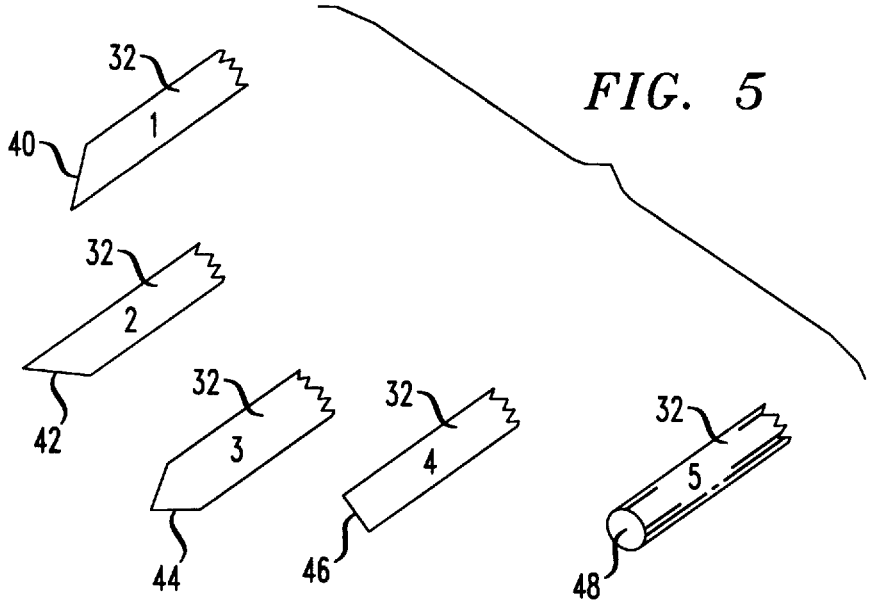
FIG. 5
FIG. 6
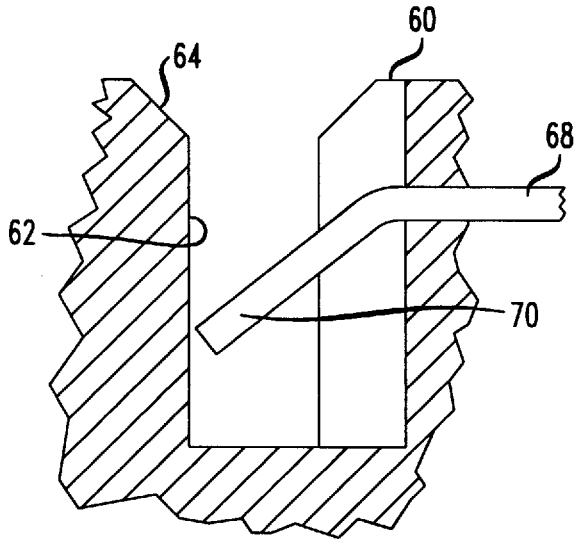

INSULATION DISPLACEMENT CONNECTOR

BACKGROUND OF THE INVENTION

1. Field of the Invention

The present invention relates to connectors for insulated wire conductors, and particularly to an insulation displacement connector and a method of making same with a very compact configuration.

2. Discussion of the Known Art

Insulation displacement connectors (IDCs) for insulated wire conductors are generally known in the industry. The IDCs prevalently used in telecommunication applications, known as "slotted-beam" IDCs, are disclosed, for example, in U.S. Pat. Nos. 3,027,536 (Mar. 27, 1962), 3,798,587 (Mar. 19, 1974) and 4,826,449 (May 2, 1989). A problem exists, however, in that the slotted beam IDCS require a relatively large amount of space to be allotted at the connection interface, e.g., along a connector block assembly inside a wall-mounted terminal box.

There is presently a need to miniaturize connectors, especially in telecommunications applications, so as to lessen surface area and volume required for terminal connection blocks, connector outlets, patch panels, and the like. Further, with current technological advances aiming to increase and enhance the rate of data transmission, compact connectors having short electrical connection paths are highly desirable.

A so-called "Easy-Install" plug, made by Eagle Electric Manufacturing Co. of Long Island City, New York, is also known for use on common household AC cords. The plug blades are pivoted on an inner unit of the plug, and swing apart to allow an end of an insulated AC cord to be inserted in the inner unit. When the blades are squeezed together, small prongs near the pivot points of the blades pierce the insulation on the inserted end of the cord to connect the blades with the cord conductors. See also U.S. Pat. No. 3,879,099 (Apr. 22, 1975) which relates to a flexible cable connector having insulation piercing contacts.

SUMMARY OF THE INVENTION

According to the present invention, a method of making an electrical connection with an insulated wire conductor that enters a connector housing, comprises defining a wire passage in the housing to receive an insulated wire conductor, capturing a contact member in the connector housing, the contact member having electrically conductive hook means for engaging and displacing insulation on the wire conductor, and projecting an end of the hook means of the contact member into the wire passage in the housing. The contact member is positioned with respect to the connector housing such that the insulation on the wire conductor will slide relative to the hook means when the conductor is fed into the wire passage, and the hook means will engage and pierce the insulation on the conductor to make an electrical connection with the conductor when the conductor is displaced a certain distance in the region of the hook means.

According to another aspect of the invention, an insulation displacement connector comprises a connector housing having a wire entrance portion, and a wire passage for receiving at least one insulated wire conductor when the conductor is inserted through an opening in the wire entrance portion. At least one contact member is fixed in the connector housing, the contact member having electrically conductive hook means for engaging and piercing insulation on a corresponding wire conductor received in the wire passage, and the hook means of the contact member projects into the wire passage to traverse a path of movement of the corresponding wire conductor when the conductor is inserted in the passage. The hook means is dimensioned and arranged so that insulation on a wire conductor will slide relative to a corresponding hook means when the conductor is inserted in the wire passage, and the hook means will engage and pierce the insulation on the conductor to make an electrical connection with the conductor when the conductor is displaced a certain distance in the region of the hook means.

For a better understanding of the invention, reference is made to the following description taken in conjunction with the accompanying drawing, and the scope of the invention will be pointed out by the appended claims.

BRIEF DESCRIPTION OF THE DRAWING

In the drawing;

FIG. 5 shows various configurations of an insulation displacing end for the hook portion in FIG. 4;

FIG. 6 is a view of another connector housing taken through a section of a wire passage, and an electrical contact member captured in the housing according to the invention;

DETAILED DESCRIPTION OF THE INVENTION

Figure 1:
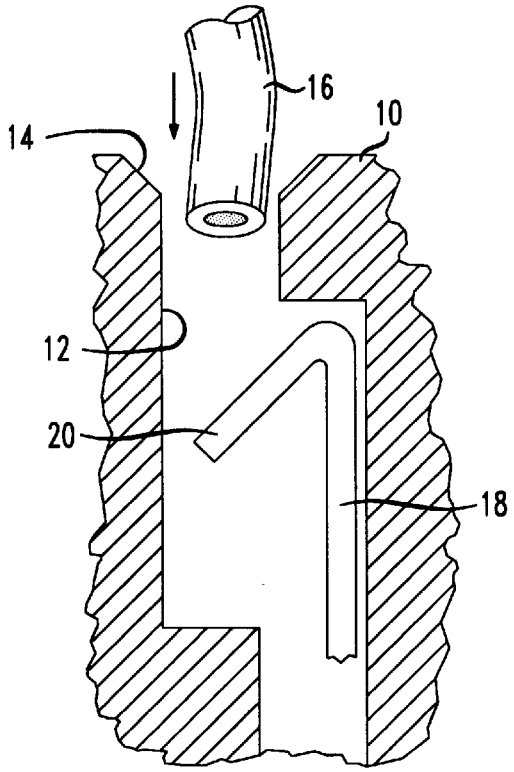
FIG. 1 is a view of a connector housing taken through a section of a wire passage, and an electrical contact member captured in the housing, according to the invention.

FIG. 1 is a view of a connector housing 10, taken through a section of a wire passage 12 defined in the connector housing 10. Materials suitable for forming the connector housing 10 may be selected from commonly used engineering thermoplastics materials, for example, polycarbonate.

The wire passage 12 communicates with the exterior of the housing 10 through a beveled or flared opening 14 on a wire entrance portion of the housing. The opening 14 is of sufficient size to receive and direct an end of an insulated wire conductor 16 into the passage 12 as shown in FIG. 1. A contact member 18 is captured in the connector housing 10 such that an electrically conductive hook portion 20 of the contact member 18 projects into the passage 12, and traverses the path of movement of the insulated wire conductor 16 when the latter is fed into the passage 12. An end of the contact member 18 not shown in FIG. 1 may, for example, form a connector terminal that projects from the housing 10, or connect with another conductor or terminal associated with the housing 10. In any event, according to the invention, the insulated wire conductor 16 is guided by the opening 14 and passage 12 to a position in the connector housing 10 at which the conductor makes an electrical connection with the hook portion 20 of the contact member 18, as explained below.

Figure 2:
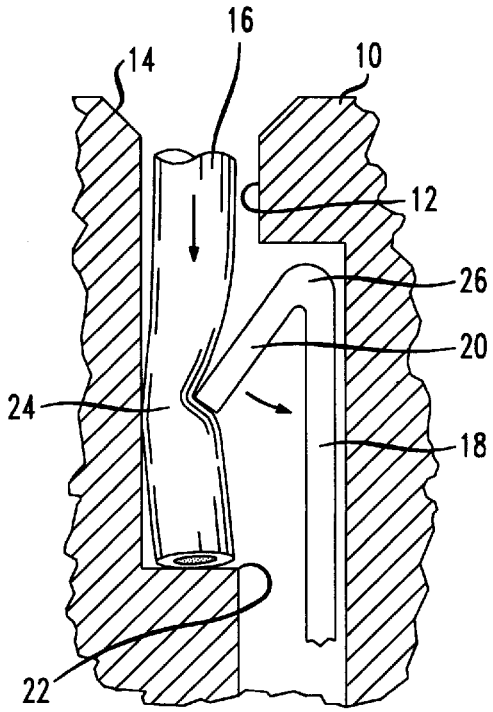
FIG. 2 is a view of the connector housing after feeding an insulated wire conductor into the wire passage.

FIG. 2 shows the insulated wire conductor 16 fully inserted in the wire passage 12 of the connector housing 10, so that the end of the conductor 16 abuts a step or wall 22 formed in the housing 10 to limit the path of movement of the conductor 16 into the housing. Insulation 24 covering the conductor 16 slides with respect to an end of the hook portion 20 of the contact member 18, and deflects the hook portion 20 toward the main body of the contact member 18 as shown in FIG. 2. Preferably, the hook portion 20 is formed of a resilient conductive material such as, e.g., beryllium copper alloy or hard phosphor bronze which is plated with a tin/lead solder to avoid corrosion.

In the condition shown in FIG. 2, the deflected hook portion 20 exerts a bias force on the surface of the insulation 24 on the wire conductor 16, urging the conductor toward the left of the wire passage 12 as viewed in FIG. 2. This bias force acts to hold the conductor 16 securely while other conductors (not shown in FIG. 2) may be inserted in other parts of the wire passage 12 to make electrical contact with other contact members supported in similar fashion in the connector housing 10.

Figure 3:
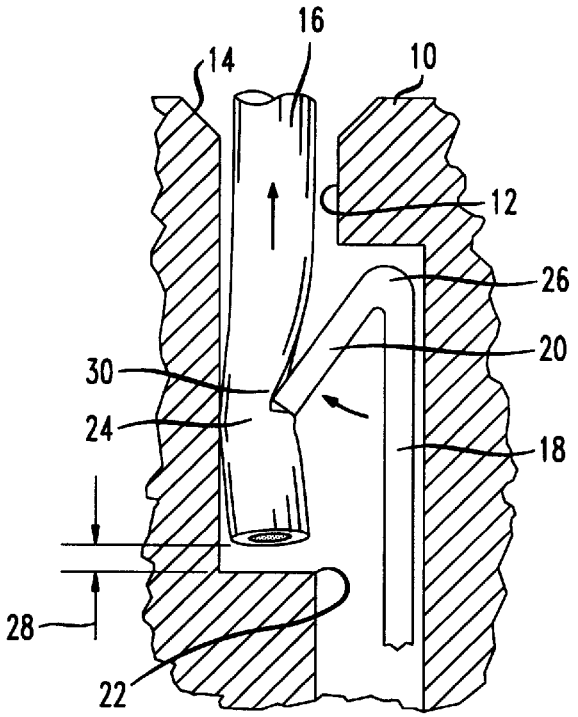
FIG. 3 is a view of the connector housing after partly withdrawing the wire conductor from the wire passage, and a hook portion of the contact member piercing insulation at the inserted end of the wire conductor.

FIG. 3 is a view of the connector housing 10 with the wire conductor 16 withdrawn or displaced a certain distance in the region of the hook portion 20, after having been fully inserted in the wire passage 12 as in FIG. 2. The end of the wire conductor 16 which abuts the step 22 in FIG. 2, is separated a certain distance 28 from the step 22 as the end of the hook portion 20 engages and displaces the insulation 24 on the conductor 16 and makes an electrical connection with the wire conductor beneath the insulation 24. In a manner of speaking the hook portion 20 "fishhooks" and pierces the insulation 24 to establish electrical contact with the conductor 16, as the insulated conductor 16 is withdrawn by the distance 28. As explained later in connection with FIGS. 7 and 8, the connector housing 10 may have an associated wire crimping portion that acts to displace the insulated conductor 16 relative to the hook portion 20 by the distance 28, once the wire conductor 16 is fully inserted in the passage 12 and then crimped with respect to the connector housing 10.

The hook portion 20 will urge its adjoining contact member 18 toward the right as viewed in FIG. 3 as the conductor 16 is drawn against the end of the hook portion, so that the contact member 18 will remain captured by the right wall of the housing passage 12 as viewed in the figure. The hook portion 20 preferably should have sufficient compliance to continue to maintain positive electrical contact with the conductor 16 at a region 30 of the conductor where its insulation is pierced by the end of the hook portion 20.

Figure 4:
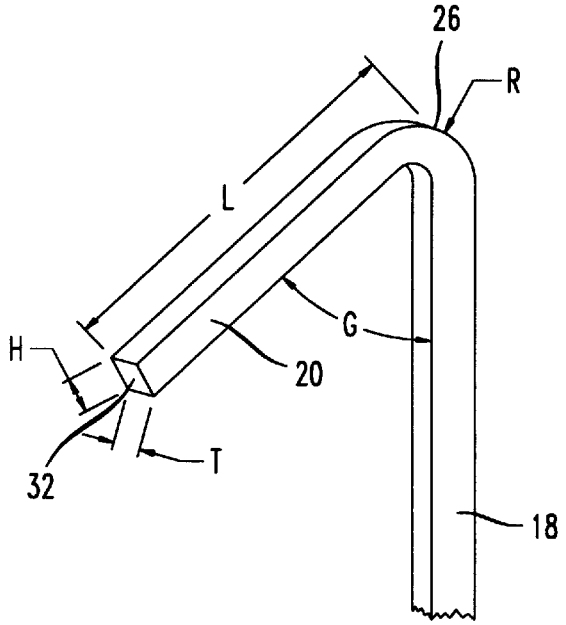
FIG. 4 is an enlarged view of the hook portion of the contact member in FIGS. 1–3.

FIG. 4 is an enlarged view of the hook portion 20, including its bend point 26 adjoining the contact member 18, and its insulation displacing or piercing end 32. Typical dimensions for the hook portion 20 are as follows:

Length (L)-about 0.070 inches

Hook portion angle (θ)-about 30 degrees

Bend radius at bend point 26 (R)-about 0.012 inches

Height (H) of hook portion end cross-section-about 0.015 inches

Width or Thickness (T) of hook portion end cross-section-about 0.015 inches

It will be understood that the form of the hook portion 20, its end 32 and adjoining contact member 18, can be varied to accommodate different ranges of wire size and insulation by varying the length L, angle θ, radius R and cross-section H, T. Also, the properties of the material selected for the hook portion 20 and contact member 18 can vary to accommodate particular applications.

FIG. 5 shows a number of possible shapes at the tip end 32 of the hook portion 20 in FIG. 4. Five possible shapes for tip end 32 include; rectangular inclined surfaces defining a knife-edge end tip 40 or 42, a wedge-shaped end tip 44, or a flat square or rectangular end tip 46. The hook portion 20 may also have a round or oval cross-section with an end tip 48 which could be cut similarly to the end tips 40, 42, 44 or 46.

FIG. 6 is a view of a connector housing 60 taken through a section showing a wire passage 62 in the housing 60. The passage 62 communicates with the exterior of the housing 60 through a beveled or flared opening 64 on a wire entrance portion of the housing. An electrically conductive contact member 68 is embedded in the housing 60, and has a hook portion 70 that projects in the passage 62. The connector arrangement of FIG. 6 is similar to that of FIG. 1, except that a portion of the contact member 68 adjoining the hook portion 70 approaches the wire passage 62 in a direction substantially perpendicular to the axis of the passage 62, rather than substantially parallel to the passage axis as in FIG. 1.

Figure 7:
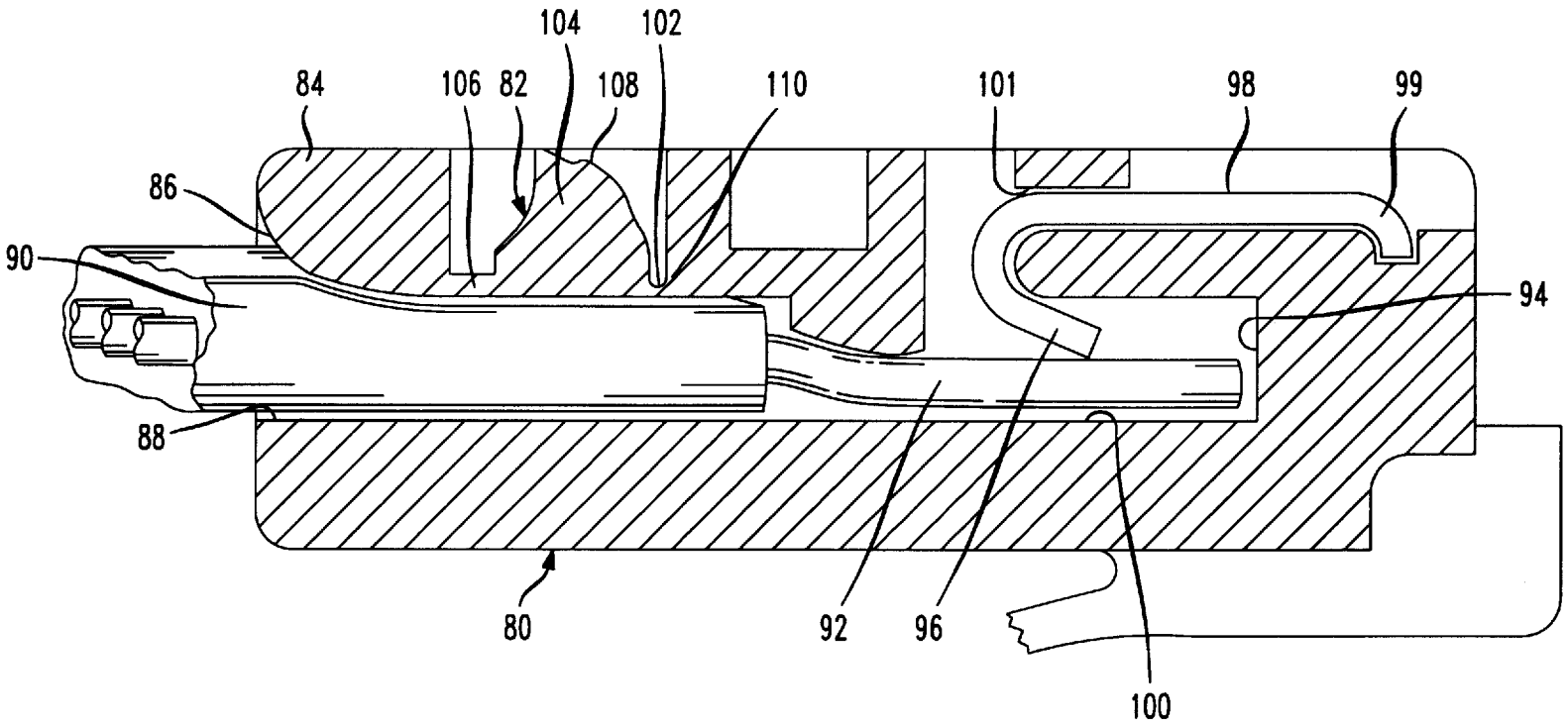
FIG. 7 is a view of a connector having a crimping portion on its housing according to the invention.

FIG. 7 is a sectional view of a modular telephone wire plug connector 80 with a crimping section 82 on a connector housing 84 according to the invention. Before insertion through an opening 86 at a cable entrance end of the housing 84 and into a passage 88, an end portion of a flat wire cable is prepared by stripping off a length of an outer cable jacket 90 from a leading end of the cable to expose a number (e.g., four to eight) of insulated wire conductors 92 one of which is seen in FIG. 7. The cable is inserted in the passage 88 until the ends of the wire conductors 92 abut a wall 94 in the connector housing 84. Preferably, the passage 88 has means for guiding individual ones of the conductors 92 into alignment with corresponding ones of a number of hook portions 96 of electrically conductive terminals 98. Such guiding means may comprise individual conductor channels or grooves along a bottom wall 100 of the passage 88, preferably below the hook portions 96 as viewed in FIG. 7.

Terminals 98 also have contact portions 99 extending on the exterior of the connector housing 84 to enable electrical contacts to be made with corresponding cable conductors, externally of the plug connector 80. Also, the terminals 98 are positioned or captured within corresponding ones of a number of terminal receiving openings 101 that communicate with the cable passage 88 and the exterior of the plug connector 80.

The cable crimping section 82 may be similar to a cable jacket anchoring member disclosed in U.S. Pat. No. 4,002,392 (Jan. 11, 1977). All relevant portions of the '392 patent are incorporated by reference herein. The present crimping section 82 has a break-away or frangible connecting region 102 similar to one in the '392 patent, but located on the plug contact member side of an anchoring member 104 rather than on the cable entrance side of the anchoring member as in the '392 patent. A connecting hinge portion 106, similar to one in the '392 patent, joins the anchoring member 104 to the connector housing 84 at the cable entrance side rather than at the plug contact member side.

When the crimping section 82 is engaged by a commercially available crimping tool, anchoring section 104 is urged downward in FIG. 7, causing the region 102 to break. The section 104 then pivots about region 106 while the lower right edge of the section 104 frictionally engages and displaces the flat wire cable toward the left in FIG. 7. Once the anchoring section 104 is pivoted to a position where a step portion 108 of the section engages an edge 110 on the connector housing, which edge was previously joined to the anchoring section 104 through the frangible region 102, the section 104 will have displaced the wire cable including the insulated wire conductors 92 a certain distance toward the cable entrance end at the left in FIG. 7. According to the invention, when the wire cable is crimped by the anchoring section 104, its conductors 92 are displaced relative to the contact member hook portions 96 by an amount sufficient to cause the hook portions to pierce the insulation and to make electrical connections with corresponding ones of the wire conductors 92.

Figure 8:
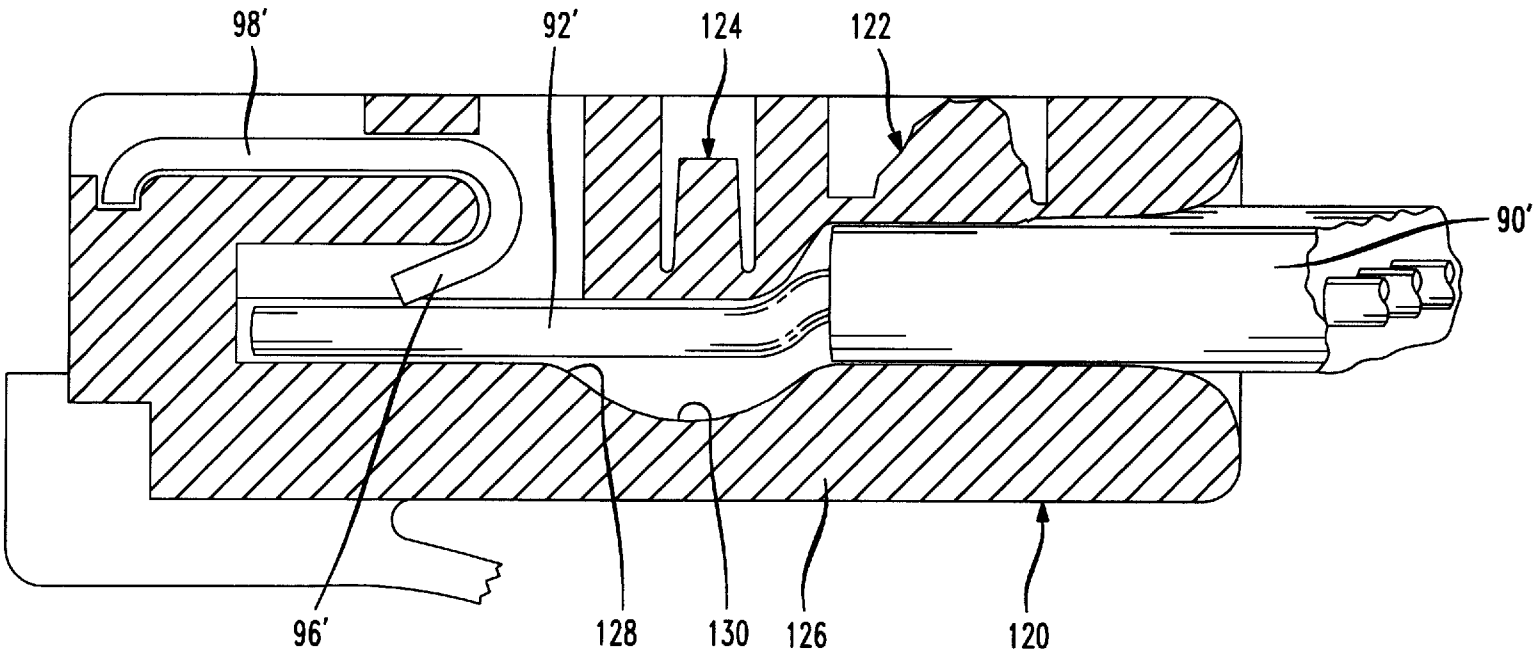
FIG. 8 is a view of another connector having a crimping portion on its housing according to the invention.

FIG. 8 is a sectional view of another embodiment of a modular telephone wire plug connector 120 according to the invention. Parts similar to those in FIG. 7 have corresponding reference numerals. The connector 120 has a cable crimping section 122 and a secondary, cable conductor strain relief section 124 formed in a connector housing 126. The configurations of the crimping section 122 and the strain relief section 124 are similar to ones disclosed in the '392 patent. In addition, the connector housing has a wire conductor passage 128 with a recess 130 formed in the passage wall opposite the strain relief section 124.

According to the invention, after the cable jacket 90' in FIG. 8 is crimped by the crimping section 122, the strain relief section 124 is urged downward to push the cable conductors 92' latterly into the recess 130. Preferably, a single tool can be adapted to perform the crimping and the strain relief operations sequentially. The extent to which the strain relief section urges the conductors 92' into the recess 130 is sufficient to displace the conductors relative to the terminal hook portions 96' and to cause the hook portions to pierce insulation on and make electrical connections with the wire conductors 92'.

The present insulation displacement connector affords the following desirable features:

1. Simplicity in manufacturing.
2. Ease of use.
3. Small, compact size allowing for a high density of contact members for a multi-conductor cable connector housing.
4. The contact members including the hook portions can be made from readily available lead frames or round wires.
5. The present use of a hook portion on the contact member in a deflection beam configuration, enables the making of a connection with a wire conductor in a way that is tolerant of various wire sizes, insulation properties, and the like.

The present connector configuration may be used in telecommunications circuits, as well as in many other electrical contact applications including, without limitation, automotive and toy manufacturing. The configuration achieves a reduction in connector size with increased performance, reliability, and ease of manufacture and use.

While the foregoing description represents preferred embodiments of the invention, it will be obvious to those skilled in the art that various changes and modifications may be made, without departing from the true spirit and scope of the invention which is pointed out by the following claims.

What I claim is:

1. A method of making an electrical connection with an insulated wire conductor that enters a connector housing, comprising;

defining a wire passage in a connector housing to receive an insulated wire conductor;

capturing a contact member in the connector housing, the contact member having electrically conductive hook means for engaging and displacing insulation on the wire conductor;

projecting an end of the hook means of the contact member into the wire passage in the connector housing;

fixing the contact member with respect to the connector housing such that the insulation on the wire conductor will slide relative to the hook means when the conductor is fed into the wire passage, and the hook means will engage and displace the insulation on the conductor to make an electrical connection with the conductor when the conductor is moved a certain distance relative to the hook means;

arranging a crimping section on the connector housing for crimping the insulated wire conductor with respect to the connector housing after the conductor is fed into the wire passage; and arranging the crimping section to move the insulated wire conductor by said certain distance when the conductor is crimped by the crimping section with respect to the connector housing.

2. A method of making electrical connections with a number of insulated wire conductors that enter a connector housing, comprising:

defining a wire passage in a connector housing to receive a number of insulated wire conductor at corresponding positions in the passage;

capturing a number of contact members in the connector housing, each of said contact members having electrically conductive hook means for engaging and displacing insulation on a different one of the wire conductors;

projecting an end of each hook means of the contact members into the wire passage so as to traverse a path of movement of a corresponding insulated wire conductor when the conductor is received in the passage;

fixing the contact members with respect to the connector housing such that the insulation on the wire conductors will slide relative to corresponding hook means when the conductors are fed into the wire passage, and each hook means will engage and displace the insulation on the corresponding conductor to make an electrical connection with the conductor when the conductor is moved a certain distance relative to the hook means;

arranging a crimping section on the connector housing for crimping the insulated wire conductors with respect to the connector housing after the conductors are fed into the wire passage; and arranging the crimping section to move the insulated wire conductors by said certain distance when the conductors are crimped by the crimping section with respect to the connector housing.

3. An insulation displacement connector, comprising:

a connector housing having a wire passage for receiving at least one insulated wire conductor when the conductor is inserted in the wire passage;

at least one contact member fixed in the connector housing, said contact member having an electrically conductive hook portion adapted to engage and pierce insulation on a corresponding wire conductor received in said wire passage, and the hook portion of said contact member projects into said wire passage to traverse a path of movement of the corresponding wire conductor when the conductor is inserted in the wire passage;

said hook portion being dimensioned and arranged so that insulation on a corresponding wire conductor will slide relative to the hook portion when the conductor is inserted in the wire passage, and said hook portion will engage and pierce the insulation on the conductor to make an electrical connection with the conductor when the conductor is moved a certain distance relative to said hook portion;

wherein the connector housing includes a crimping section for crimping at least one insulated wire conductor with respect to the housing after the conductor is inserted into said wire passage; and wherein said crimping section is constructed and arranged to move the insulated wire conductor by said certain distance when the conductor is crimped by the crimping section.

4. An insulation displacement connector according to claim 3, wherein said crimping section comprises an anchoring member having a connecting hinge portion joined to the connector housing at a cable entry side of the anchoring member, and a frangible connecting part on a contact member side of the anchoring member and releasably connected to the connector housing, for enabling the anchoring member to break away from said housing and to pivot about said hinge portion when urged by a tool toward the insulated wire conductor, wherein said anchoring member frictionally engages the conductor and displaces the conductor said certain distance relative to a contact member hook portion.

5. An insulation displacement connector according to claim 3, wherein said crimping section comprises an anchoring member having a connecting hinge portion joined to the connector housing on a contact member side of the anchoring member, and a frangible connecting part at a cable entry side of the anchoring member and releasably connected to the connector housing, to allow the anchoring member to break away from said housing and to pivot about said hinge portion when urged by a tool toward the insulated wire conductor, a strain relief section adjacent the contact member side of the anchoring member, and said connector housing has a wire conductor passage wall with a recess formed opposite said strain relief section, wherein the strain relief section is constructed and arranged to urge a conductor in the vicinity of the strain relief section into said recess by an extent sufficient to cause the conductor to be displaced said certain distance relative to said hook portion.

6. An insulation displacement connector according to claim 3, wherein said connector housing is channeled or grooved to guide individual ones of a number of insulated wire conductors into alignment with hook portions of corresponding ones of the contact members.

7. An insulation displacement connector according to claim 6, wherein said channels or grooves are formed in a wall of said wire passage in the region of hook portions of corresponding contact members.

8. An electrical connector for terminating a wire cable and for making electrical contact externally of the connector, comprising:

a connector housing having a cable passage for receiving an end portion of a wire cable comprised of a number of insulated wire conductors;

said housing having a number of terminal-receiving openings communicating with the cable passage and the exterior of the connector; and a number of electrically conductive terminals positioned within corresponding ones of the terminal-receiving openings in the connector housing each of said terminals comprising a hook-portion projecting into said cable passage, said hook portion being dimensioned and arranged so that insulation on a corresponding wire conductor will slide relative to the hook portion when the conductor is inserted in the cable passage, and said hook portion will engage and pierce the insulation on the conductor to make an electrical connection with the conductor when the conductor is moved a certain distance relative to said hook portion, and a contact portion extending on the exterior of the connector housing for making an electrical contact with the corresponding conductor externally of the connector;

wherein the connector housing includes a crimping section for crimping said wire cable with respect to the housing after the end portion of the cable is inserted into said cable passage; and wherein said crimping section is constructed and arranged to move a wire conductor of the cable by said certain distance when the cable is crimped by the crimping section.

9. An electrical connector according to claim 8, wherein said crimping section comprises an anchoring member having a connecting hinge portion joined to the connector housing at a cable entrance side of the anchoring member, and a frangible connecting part on a contact member side of the anchoring member and releasably connected to the connector housing, for enabling the anchoring member to break away from said housing and to pivot about said hinge portion when urged by a tool toward the cable, wherein said anchoring member frictionally engages the cable and displaces a cable conductor by said certain distance relative to a contact member hook portion.

10. An electrical connector according to claim 8, wherein said crimping section comprises an anchoring member having a connecting hinge portion joined to the connector housing on a contact member side of the anchoring member, and a frangible connecting part at a cable entry side of the anchoring member and releasably connected to the connector housing, to allow the anchoring member to break away from said housing and to pivot about said hinge portion when urged by a tool toward the wire cable, a strain relief section adjacent the contact member side of the anchoring member, and said connector housing has a cable passage wall with a recess formed opposite said strain relief section, wherein the strain relief section is constructed and arranged to urge a cable conductor in the vicinity of the strain relief section into said recess by an extent sufficient to cause the conductor to be displaced by said certain distance relative to said hook portion.

11. An electrical connector according to claim 8, wherein said connector housing is channeled or grooved to guide individual ones of a number of wire conductors of said cable into alignment with hook portions of corresponding ones of the electrically conductive terminals.

12. An electrical connector according to claim 11, wherein said channels or grooves are formed in a wall of said cable passage in the region of hook portions of corresponding conductive terminals.

* * * * *